US007815532B2

(12) United States Patent
Harpell

(10) Patent No.: US 7,815,532 B2
(45) Date of Patent: Oct. 19, 2010

(54) PRACTICE HOCKEY PUCK

(76) Inventor: Shawn Harpell, 1439 Mildred St., Kingston, ON (CA) K6L 4V4

( * ) Notice: Subject to any disclaimer, the term of this patent is extended or adjusted under 35 U.S.C. 154(b) by 253 days.

(21) Appl. No.: 12/152,821

(22) Filed: May 19, 2008

(65) Prior Publication Data

US 2008/0300072 A1 Dec. 4, 2008

Related U.S. Application Data

(63) Continuation-in-part of application No. 11/809,837, filed on May 31, 2007, now abandoned.

(51) Int. Cl.
*A63B 71/00* (2006.01)

(52) U.S. Cl. ..... 473/588

(58) Field of Classification Search ..... 473/588, 473/589

See application file for complete search history.

(56) References Cited

U.S. PATENT DOCUMENTS 2,226,516 A * 12/1940 Ross ..... 473/588
2,640,699 A * 6/1953 Garbo ..... 473/588
3,954,267 A * 5/1976 Freeman et al. ..... 273/126 A
5,269,520 A * 12/1993 Vellines ..... 473/588
5,695,420 A * 12/1997 Bellehumeur ..... 473/588
2003/0195067 A1* 10/2003 Hartman et al. ..... 473/588
2008/0300072 A1* 12/2008 Harpell ..... 473/446
2008/0300074 A1* 12/2008 Harpell ..... 473/588

FOREIGN PATENT DOCUMENTS

CA 409410 12/1942

* cited by examiner

*Primary Examiner*—Raleigh W. Chiu

(57) ABSTRACT

A practice hockey puck to be used by a young player to learn how to pick up a hockey puck off the ice with the blade of his hockey stick or to stickhandle on pavement or asphalt. The puck is like an ordinary puck but with a lower, outer, annular portion removed, thereby moving the outer peripheral edge of the bottom surface of the puck inwardly from the outer peripheral edge of the top portion of the puck. The outer peripheral edge of the bottom surface acts as a pivot edge. A portion of the puck lies outside this pivot edge. Pressing on this portion of the puck with the blade of the stick allows the player to easily pivot the puck about the pivot edge onto its side starting the process of picking the puck up with the stick. When the practice puck is inverted it can be used to practice stickhandling on a non-ice surface such as pavement or asphalt. The puck, in its inverted position, is contacted by the stick at a lower height on the puck making it less easy to tilt or tumble than a regular puck and thus easier to stickhandle on a difficult surface.

23 Claims, 3 Drawing Sheets

PRACTICE HOCKEY PUCK

BACKGROUND OF THE INVENTION

1. Technical Field

This invention is directed toward a hockey puck. The invention is more particularly directed toward a practice hockey puck. The practice hockey puck can be used by a player to practice puck handling skills with a hockey stick.

2. Background Art

Young hockey players like to emulate the professional hockey players. They see the players picking up the puck on the blade of their stick, to hand it to the referee for example, and try to do the same. They also would like to stickhandle the puck back and forth with their stick as the professionals do. These puck handling skills are difficult to practice however with a regular hockey puck.

To normally practice picking up a puck with his stick, a player places the front of the blade of his stick flat on the top of the puck on the ice. He then applies pressure to one side of the puck with the edge of the blade on that side to pivot or tip the puck about its lower edge up on its side. From its on-side position, with the blade now positioned against the top of the puck, the blade is moved against the puck with its bottom edge leading while rotating the blade up to a horizontal position. This movement tips the puck back against the direction of blade movement to have the puck fall flat on top of the blade. It is difficult for a young player to get a feel for the amount of pressure to be applied, and where and how the pressure should be applied, on a regular puck with the stick to tip the puck onto its side.

Young players often practice stickhandling with a regular puck in the basement, on concrete, or on the driveway, on asphalt. The players tend to turn the blade of the hockey stick over slightly contacting the upper edge of the puck to slide it from side to side. However, the pucks do not slide well on concrete or asphalt and the force applied to the upper edge of the puck by the blade of the stick often tips or tumbles the puck about its bottom edge opposite the side of the upper edge where the stick blade contacts the puck. Tipping or tumbling pucks make it difficult to practice stickhandling.

SUMMARY OF THE INVENTION

The practice puck of the present invention is designed to make it easier for the player to practice picking up the puck off the ice with his stick. The puck is designed to help the player to find the correct pressure point on the puck and the amount of pressure needed to tip the puck onto its side. Once on its side, the puck is easier for the player to pick up with his stick. The puck is designed, when flat on the ice in one position, to have an overhang past the bottom edge of the puck making it much easier to tip the puck about the bottom edge onto its side. The overhang is achieved by providing the puck with a top surface having a circular top peripheral edge and a bottom surface, parallel to the top surface, having a circular bottom peripheral edge that lies within the top peripheral edge of the top surface. The bottom peripheral edge is concentric within the top peripheral edge. A side surface joins the bottom surface to the top surface. In one embodiment, the puck has an inverted, right truncated conical shape. In this embodiment, the side wall extends up from the bottom peripheral edge of the bottom surface to the top peripheral edge of the top surface at an angle ranging between one hundred degrees and one hundred and thirty-five degrees. In a preferred embodiment, the puck has an upper cylindrical portion and an integral lower portion, the upper portion having the top surface and the lower portion having the bottom surface. The lower portion can have an inverted, right truncated conical shape or a cylindrical shape of smaller diameter than the upper portion. The upper portion is preferably between one quarter and three quarters the thickness of the puck.

It will be seen in all embodiments that the upper part of the puck overhangs the bottom surface. Pressing down on the outer part of the upper part of the puck with the blade of a stick readily tips it about the bottom peripheral edge on the bottom of the puck. The puck is tipped till it abuts on the side surface. Once on its side surface it can be easily picked up with the blade of the stick. Once a young player has practiced with the practice puck to build a feel for the amount of, and the location of, the pressure to be applied to initially tip the puck, he can more easily and quickly learn to pick up a regular puck.

The practice puck can also be used in an inverted position to practice stickhandling on a surface such as a basement floor or a driveway. The player can more easily move the practice puck from side to side on the surface in its inverted position than he can move a regular puck since the blade of the stick can contact the practice puck lower down, closer to the surface. Contacting the puck lower down to move it reduces the risk of tipping or tumbling the puck.

The invention is particularly directed toward a practice hockey puck having a top surface with a circular top peripheral edge and a bottom surface, parallel to the top surface, having a circular bottom peripheral edge. The bottom peripheral edge is concentric within the top peripheral edge when seen from the bottom. A side surface joins the top and bottom surfaces extending between the top and bottom peripheral edges. At least a bottom portion of the side surface extending from the bottom surface will extend upwardly at an angle of between ninety and one hundred and fifty five degrees to the bottom surface.

The invention is also particularly directed toward a practice hockey puck having an upper cylindrical portion with a top circular peripheral edge and a lower portion with a bottom circular peripheral edge. The bottom circular peripheral edge is smaller in diameter than the top circular peripheral edge and the upper portion is one quarter to three quarters the thickness of the puck. The upper portion overhangs the lower portion.

DETAILED DESCRIPTION OF THE INVENTION

Figure 1:
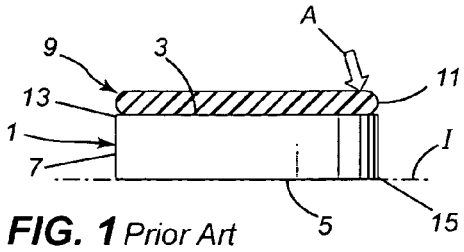
FIG. 1 Prior Art
FIG. 1 is a schematic view showing where pressure is applied to a regular puck to tip it onto its side.
Figure 2:
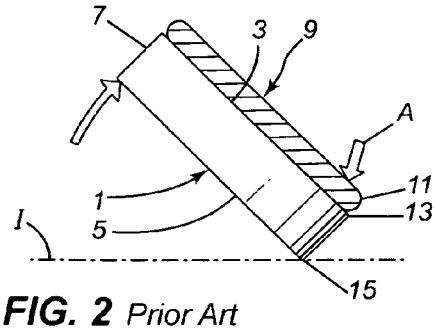
FIG. 2 Prior Art
FIG. 2 is a schematic view showing the puck moving onto its side.
Figure 3:
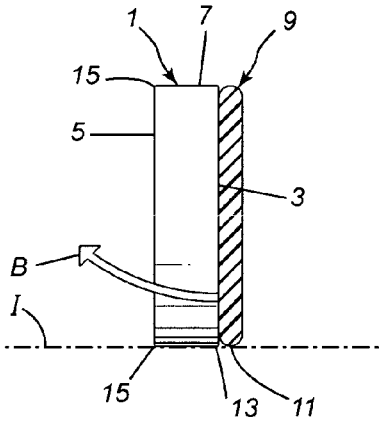
FIG. 3 Prior Art
FIG. 3 is a schematic view showing the on-side puck being rotated by the blade.

In the prior art, an ordinary hockey puck 1, as shown in FIGS. 1 to 4, is a cylindrical disk three inches in diameter and one inch thick having a top circular surface 3 and a parallel bottom circular surface 5. A cylindrical side surface 7 joins the top and bottom surfaces 3, 5. To pick up the puck lying on the ice 'I' with his hockey stick, a player first places the front of the blade 9 of his stick flat on the top surface 3 of the puck 1. Through the handle of the stick, the player then applies pressure, as shown by the arrow 'A', through the bottom edge 11 of the blade 9 to the top of the puck 1 adjacent its top edge 13 as shown in FIG. 1. The pressure is applied mainly downwardly but also slightly outwardly in a manner tending to rotate the puck about its bottom edge 15, as shown in FIG. 2, to sit on its side surface 7 with the blade 9 now vertical and still adjacent the top surface 3 of the puck as shown in FIG. 3. The blade 9 of the stick is then used to sweep the upstanding puck up while rotating the blade to a horizontal position. The puck is swept up as shown by the arrow B in FIG. 3 with pressure applied against the bottom of the puck by the bottom edge 11 of the blade 9. The blade 9 tips the puck backwards onto the blade of the stick while carrying the puck to a horizontal position resting flat on the blade 9, the blade now upside down from its initial position. The sequence shown through FIGS. 1-4 occurs in one fluid motion.

The manner of applying pressure with the blade of the stick to a puck lying on the ice to rotate it upright is difficult to learn. To help a young player learn, a practice puck is provided having a construction making it easier to rotate the puck from a flat position on the ice onto its side using a hockey stick blade. The practice puck is provided with a bottom edge located inwardly of the side of the puck. The puck has an overhang outwardly of the bottom edge. The overhang has an intermediate edge between the bottom edge and the top edge of the puck. The overhang makes it easier to initially tip the puck about the bottom edge with the blade of the stick applying pressure to the top surface of the puck adjacent its side. This pressure is applied outwardly of the bottom edge making it easy to tip the puck. The puck is first tipped about the bottom edge until the intermediate edge, provided by the overhang and located above and outwardly of the bottom edge, touches the ice. The application of pressure is continued with the blade to now continue tipping the puck about the intermediate edge until the puck is upright on its side.

Figure 5:
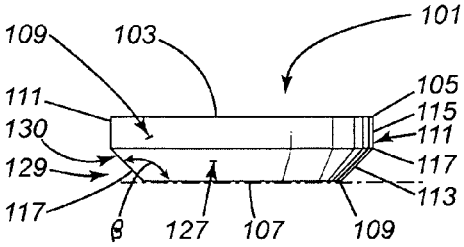
FIG. 5 shows a practice puck.

In more detail, the preferred practice hockey puck 101 of the present invention, as shown in FIG. 5, is in the shape of a modified cylindrical disk and has a top surface 103 with a circular, top, peripheral edge 105. The puck has a bottom surface 107, parallel to the top surface 103, having a circular, bottom, peripheral edge 109. The bottom peripheral edge 109 is smaller than the top peripheral edge 105 and is concentric within the top peripheral edge 105 when looking at the bottom of the puck. A side surface 111 joins the top and bottom surfaces 103, 107. The side surface 111 preferably has a lower angled portion 113 extending upwardly and outwardly from the bottom peripheral edge 109 and an upper, vertical portion 115 extending down from the top peripheral edge 105 to join the lower angled portion 113. A circular, intermediate edge 117 is formed where the upper portion 115 of the side surface 111 joins the lower portion 113. The lower portion 113 of the side surface 111 can extend upwardly and outwardly at an angle β to the bottom surface 107 that ranges between one hundred and fifteen degrees and one hundred and fifty-five degrees. The upper portion 115 of the side surface 111 can have a height of between about one-quarter and three-quarters the thickness or height of the puck. When the upper portion 115 of the side surface 111 is about one-quarter the height of the puck, the angle β is about one hundred and fifteen degrees and when the upper portion is about three-quarters the height of the puck, the angle β is about one hundred and fifty-five degrees. Preferably the height of the upper portion is between about one-half and five-eighths the height of the puck and the angle β is around one hundred and thirty-five degrees. The side surface 111 divides the puck into a cylindrical upper portion 125 and an inverted, right-truncated, conical lower portion 127. The angled lower portion 113 of the side surface 111 forms an undercut 129 in the lower, outer portion of the puck leaving an overhanging portion 130 over the undercut 129 formed by an upper, outer portion of the puck.

Figure 6:
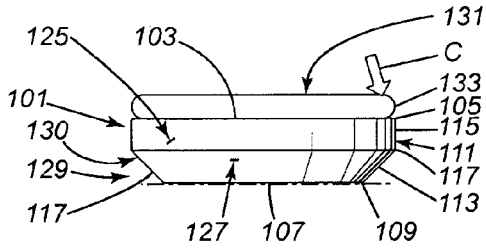
FIG. 6 is a schematic view showing where pressure is initially applied to the practice puck.
Figure 7:
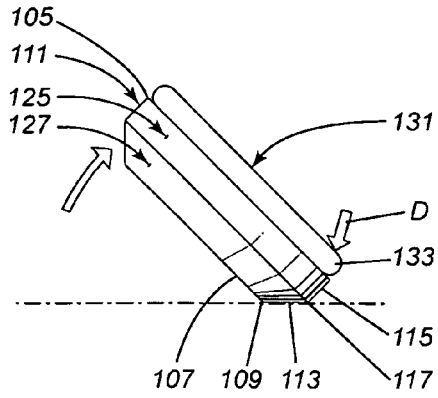
FIG. 7 shows the puck at a further pressure applying stage.
Figure 8:
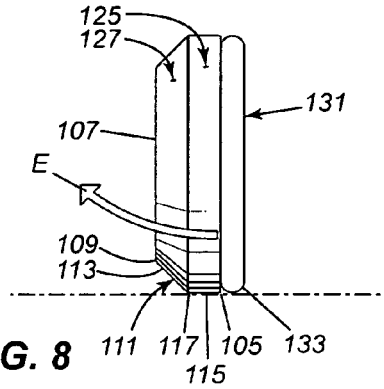
FIG. 8 shows the practice puck on its side.

In using the practice puck 101, with the puck flat on the ice 'I' on the bottom surface 107, the player places the blade 131 of his hockey stick flat on the top surface 103 of the puck, as shown in FIG. 6 and with the bottom edge 133 of the blade 131 presses down on the puck adjacent its side surface 111 as shown by the arrow 'C'. The pressure is applied by the edge 133 of the blade on the overhanging portion 130 of the puck which lies outside of the bottom edge 109 of the puck causing the puck to easily tip about the bottom edge 109 onto the lower angled side surface portion 113 as shown in FIG. 7. In this position the puck is already about half upright. Continued pressure by the edge 133 of the blade 131 on the puck adjacent its side surface 111 causes the puck to easily continue pivoting upright about the intermediate edge 117 until it rests on the upper portion 115 of its side surface 111 as shown in FIG. 8. The downward pressure applied by the edge 133 of the hockey stick, as shown by the arrow 'D', is at or just outside the intermediate edge 117 making the puck pivot easily upright.

Figure 4:
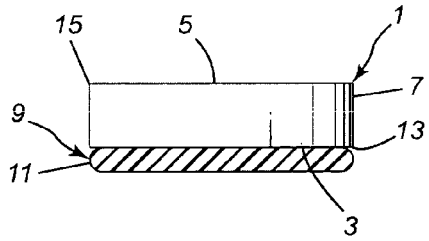
FIG. 4 Prior Art
FIG. 4 shows the puck flat on the blade of the stick.

Once the puck is on its side surface 111, the player can then sweep the puck sideways and up with the blade of the stick as shown by the arrow 'E', in FIG. 8, to complete the pick-up in the same manner the regular puck is picked up as shown in FIGS. 3 and 4. The puck is swept up with pressure applied against the bottom of the puck, adjacent the top edge 105, by the bottom edge 133 of the blade 131. The blade 133 tips the puck backwards onto the blade of the stick while carrying the puck to a horizontal position resting flat on the blade 133. After a player practices with the practice puck 101 he gets a feel for the manner in which, and where, the pressure must be applied to tilt the puck upright and he can transfer this feel to tilting a regular pick upright.

Figure 9:
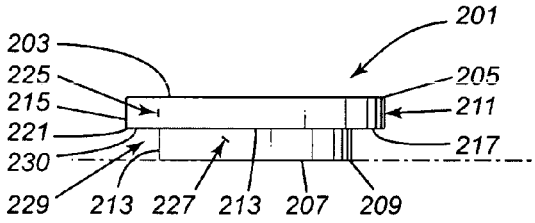
FIG. 9 shows a modification of the practice puck.
Figure 10:
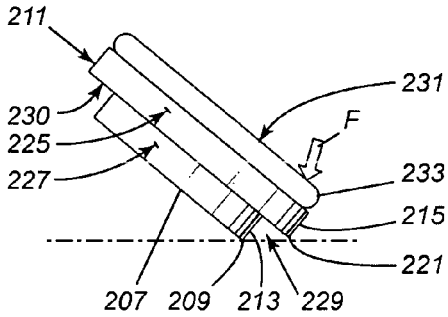
FIG. 10 shows the puck of FIG. 9 tilted.

The practice puck can have different shapes to provide the undercut and overhanging portion. As shown in FIGS. 9 and 10, the practice puck 201 can have a modified cylindrical shape with a top surface 203 having circular top peripheral edge 205. The puck has a bottom surface 207, parallel to the top surface 203, having a circular bottom peripheral edge 209. The bottom edge 209 is smaller than the top edge 205 and is concentric within the top edge 205 when looking at the bottom of the puck. A side surface 211 joins the top and bottom surfaces 203, 207. The side surface 211 is stepped having a lower, vertical portion 213 extending upwardly from the circular bottom edge 209 and an upper, vertical portion 215 extending down from the circular top edge 205. A horizontal portion 217 extends inwardly from the bottom of the upper vertical portion 215 to join with the top of the lower vertical portion 213. An intermediate edge 221 is formed where the upper portion 215 of the side surface 211 joins the horizontal portion 217. The stepped side surface 211 divides the puck into a cylindrical upper portion 225 and a smaller, cylindrical, lower portion 227. An undercut 229 is formed in the lower, outer portion of the puck adjacent the cylindrical bottom portion 227 leaving an overhanging portion 230 over the undercut 229 formed by an outer portion of the cylindrical top portion 225 of the puck. The top portion 225 can have a thickness ranging between one quarter and three quarters the thickness of the puck but preferably around one half to five eighths the thickness of the puck.

As with the puck 101, a blade 231 of a hockey stick is laid flat on the top 203 of the puck and pressure is applied along one edge 233 of the blade as shown by the arrow 'F' to tip the puck first about the bottom edge 209 until the intermediate edge 221 hits the ice I, and then about the intermediate edge 221, as shown in FIG. 10, until the puck rests upright on the upper vertical portion 215 of the side surface 211. The pressure is applied on the overhang 230 outside of the bottom and intermediate edges 209, 221 to make it easy to move the puck to an upright position.

Figure 11:
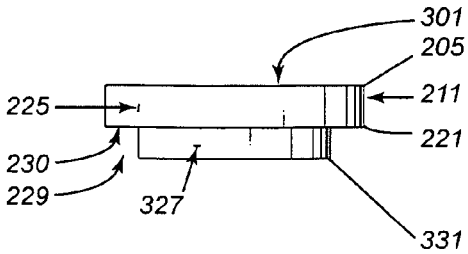
FIG. 11 shows another modification of the practice puck.
Figure 12:
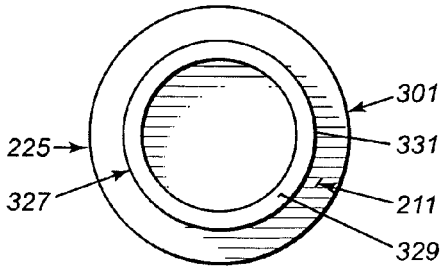
FIG. 12 shows a bottom view of the puck shown in FIG. 11.

The bottom cylindrical portion 227 of the practice puck 201 could be replaced with a bottom cylindrical ring portion, as shown in FIGS. 11 and 12, to provide a practice puck 301. The puck 301 has an upper cylindrical portion 225, as in puck 201, and a lower cylindrical ring portion 327. The ring portion 327, as with the lower cylindrical portion 227 in puck 201, is smaller in diameter than the upper cylindrical portion 325 but concentric within it. The ring portion 327 has an annular bottom surface 329 and a circular bottom peripheral edge 331. The remaining features of the puck 301 are the same as the puck 201 with the puck having a stepped side surface 211 leading up from the bottom edge 331 to an intermediate edge 221 and then to the top edge 205, an undercut 229 and an overhang 230. The puck 301 is tipped in the same manner that the puck 201 is tipped.

Figure 13:
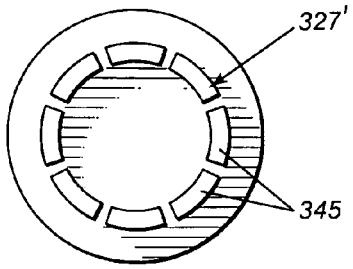
FIG. 13 shows a bottom view of another modified practice puck.
Figure 14:
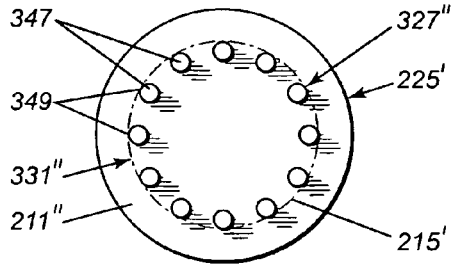
FIG. 14 shows a bottom view of yet another modified practice puck.

If desired, the cylindrical ring portion 327' could be discontinuous composed of ring segments 345 as shown in FIG. 13. Alternatively, the cylindrical ring portion 327" could be discontinuous composed of a ring of small protuberances such as small cylindrical posts 347 as shown in FIG. 14. The posts 347 project from the bottom of the upper cylindrical portion 225'. The outer peripheral portion 349 of the posts 347 define a broken, circular, bottom peripheral edge 331' and form a discontinuous lower vertical portion 215' of the stepped side surface 211'.

Figure 15:
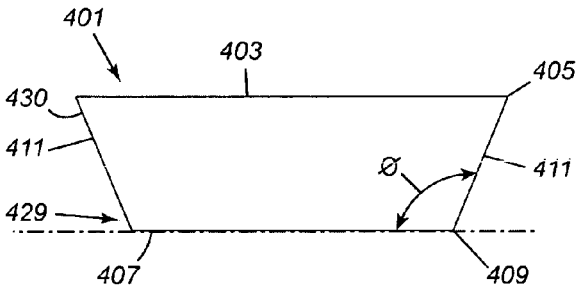
FIG. 15 shows a side view of another version of the practice puck.
Figure 16:
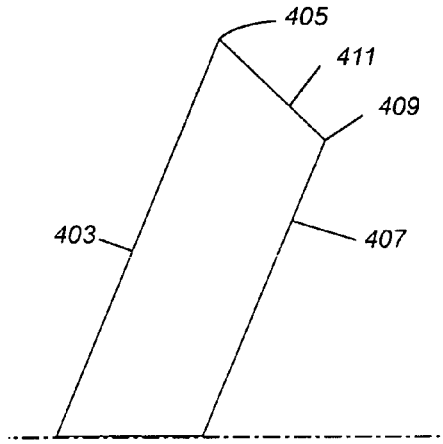
FIG. 16 shows the puck of FIG. 15 on its side.

In another embodiment, the puck could be tapered having a right truncated conical shape as shown in FIGS. 15 and 16. The puck 401 has a top surface 403 with a circular top peripheral edge 405 and a bottom surface 407, parallel to the top surface 403, having a circular bottom peripheral edge 409. The bottom edge 409 is smaller than the top edge 405 and is concentric within the top edge 405 when looking at the bottom of the puck. A straight side surface 411 joins the edges 405, 409 of the top and bottom surfaces 403, 407. The side surface 411 extends up an angle Ø to the bottom surface 407 that can range between about one hundred degrees and about one hundred and thirty-five degrees. The puck has an undercut 429 adjacent the side surface 411 and an overhang 430 inwardly from the top edge 405. The puck is tipped as before by pressing down on the puck adjacent the top edge 405 with the blade of a hockey stick to tip the puck onto its side surface 411 as shown in FIG. 16. Pushing against the top edge at the bottom of the tipped puck with the edge of the blade of the stick will cause the puck to fall back from its tipped position to a flat position on the blade of the sick.

It will be obvious that other shapes or forms could be provided for the pucks having a smaller lower portion. The lower portion could, for example, be octagonal or hexagonal in shape. The only criteria for the lower portion is that it must be smaller than the upper portion, generally centered with respect to the upper portion, provide a bottom edge located within the outer diameter of the puck, and have at least a portion of sidewall that extends up from the bottom edge at an angle to the bottom surface of the lower portion that is between ninety degrees and one hundred and fifty-five degrees. The bottom side surface (113, 213) joining the bottom surface of the lower portion of the puck to the top side surface of the upper portion of the puck can have other shapes as well. The bottom side surface could have a curved cross-section for example, curving gradually up and out from the outer edge of the bottom surface of the lower portion to the bottom edge of the top, side surface. It could also angle up and out from the outer edge of the bottom surface to the bottom surface of the upper portion, and then continue outwardly to the bottom edge of the top, side surface.

Figure 17:
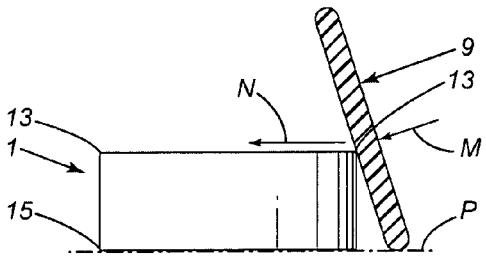
FIG. 17 Prior Art
FIG. 17 shows a regular puck being stickhandled.

The practice pucks described above can be inverted on non-ice surfaces such as pavement, asphalt, or wood by way of example, and used to practice stickhandling. When a regular puck 1 is being stickhandled on a non-ice practice surface P, as shown in FIG. 17, the blade 9 of the hockey stick is normally tilted slightly toward the top edge of the puck to 'cup' the puck with the stick and as a result the blade applies pressure, shown by arrow M, to the top edge 13 of the puck. The horizontal component of this pressure, shown by the arrow N, has a large moment leg equal to the height of the puck, and tends to tip and tumble the puck about its bottom edge 15 on the opposite bottom side of the puck from where the pressure is being applied making it very difficult to practice stickhandling.

Figure 18:
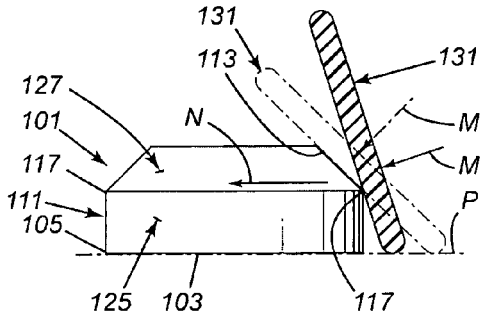
FIG. 18 shows the practice puck of FIG. 5 being stickhandled while inverted on the practice surface.

The practice pucks described above however, when inverted, slide more easily on the non-ice surface when being stickhandled and are less prone to tipping or tumbling. The practice puck 101 for example, shown in FIGS. 5-8, can be inverted on the non-ice practice surface P as shown in FIG. 18 to rest on its top surface 103. The blade 131 of the hockey stick is laid against the side of the inverted puck, while resting on its edge on the surface P and then rolled about the intermediate edge 117 of the side surface 111 of the puck. When pressure is applied to the inverted puck with the blade 131 of a hockey stick to stickhandle the puck, during rolling of the stick about the intermediate edge 117, the pressure M is applied at the intermediate edge 117 of the puck which location is well below the normal height of the puck and the horizontal force N applied by the blade 131 thus has a much shorter moment leg above the top surface 103 of the puck making it more difficult to tilt and tumble the puck about its top edge 105 opposite from where the blade contacts the intermediate edge 117. Continued rolling of the stick about the intermediate edge 117 brings the blade 131 of the stick flat against the angled side surface 113 of the bottom portion 127 of the inverted puck as shown by dash lines in FIG. 18. Pressure M is now applied against the angled surface 113 of the puck and directed toward the bottom center of the puck well within the top edge 105 of the puck. The tendency of the inverted puck to tip and/or tumble on the practice surface is further minimized making stickhandling practice much easier.

The practice puck of the invention can be the same size as a regular puck with an overall diameter of three inches and an overall height of one inch. The practice puck can also be a different size from a regular puck but preferably with the same proportions, such as for example, a practice puck with a diameter of two inches and a height of two thirds of an inch which is suitable for a younger player.

I claim:

1. A practice hockey puck having a top surface with a circular top peripheral edge and a bottom surface, parallel to the top surface, having a circular bottom peripheral edge of smaller diameter than the top peripheral edge, the bottom peripheral edge concentric within the top peripheral edge when seen from the bottom; a side surface joining the top and bottom peripheral edges of the top and bottom surfaces; at least a lower portion of the side surface extending from the bottom surface upwardly at an angle of between ninety degrees and one hundred and fifty five degrees to the bottom surface.

2. A practice hockey puck as claimed in claim 1 wherein the side surface extends upwardly and outwardly from the bottom edge of the bottom surface to the top edge of the top surface at an angle of between one hundred degrees and one hundred and thirty five degrees.

3. A practice hockey puck as claimed in claim 1 wherein the side surface has a lower surface portion extending upwardly and outwardly from the bottom edge and an upper surface portion extending down from the top edge to join the lower surface portion to form an intermediate edge, the intermediate edge vertically aligned with the top edge, the intermediate edge dividing the puck into an upper cylindrical portion and a lower, inverted, right-truncated, conical portion.

4. A practice hockey puck as claimed in claim 3 wherein the lower surface portion extends up and outwardly at an angle to the bottom surface ranging between one hundred and fifteen degrees and one hundred and fifty-five degrees and wherein the intermediate edge is between one quarter and three quarters the thickness of the hockey puck above the bottom surface.

5. A practice hockey puck as claimed in claim 3 wherein the difference in diameter between the top and bottom surfaces is about equal to twice the height of the lower portion.

6. A practice hockey puck as claimed in claim 1 wherein the side surface has a lower surface portion extending transversely up from the bottom edge, an upper surface portion extending transversely down from the top edge, and a horizontal surface portion joining the bottom of the upper surface portion to the top of the lower surface portion; an intermediate edge formed where the horizontal surface portion joins the upper surface portion, the horizontal surface portion dividing the puck into an upper cylindrical portion and a lower cylindrical portion.

7. A practice hockey puck as claimed in claim 6 wherein the angle of an imaginary line, joining the bottom edge to the intermediate edge is between one hundred and fifteen degrees and one hundred and fifty five degrees to the bottom surface and wherein the intermediate edge is between one quarter and three quarters the thickness of the puck above the bottom surface.

8. A practice hockey puck as claimed in claim 7 wherein the lower cylindrical portion is a cylindrical ring portion.

9. A practice hockey puck as claimed in claim 8 wherein the cylindrical ring portion is discontinuous.

10. A practice hockey puck as claimed in claim 6 wherein the lower cylindrical portion is a cylindrical ring portion.

11. A practice hockey puck as claimed in claim 10 wherein the cylindrical ring portion is discontinuous.

12. A practice hockey puck as claimed in claim 6 wherein the difference in diameter between the top and bottom surfaces is about equal to twice the height of the lower portion.

13. A practice hockey puck having an upper cylindrical portion with a top circular peripheral edge and a lower portion with a bottom circular peripheral edge; the bottom circular peripheral edge being smaller in diameter than the top circular peripheral edge; the upper portion being one quarter to three quarters the thickness of the puck; the upper portion overhanging the lower portion.

14. A practice hockey puck as claimed in claim 13 wherein the height of the lower portion is about equal to the difference in diameter between the top and bottom circular peripheral edges.

15. A practice hockey puck as claimed in claim 14 wherein the top of the lower portion has a circular periphery the same diameter as the upper portion.

16. A practice hockey puck as claimed in claim 13 wherein the lower portion is an inverted, right truncated, conical section.

17. A practice hockey puck as claimed in claim 13 wherein the lower portion is a cylindrical portion of smaller diameter than the upper portion.

18. A practice hockey puck as claimed in claim 17 wherein the height of the posts is about half the difference in diameter between the top and bottom portions.

19. A practice hockey puck as claimed in claim 18 wherein the upper portion is one quarter to three quarters the thickness of the puck.

20. A practice hockey puck as claimed in claim 18 wherein the height of the posts is about half the difference in diameter between the upper and lower portions.

21. A practice hockey puck as claimed in claim 20 wherein the bottom side surface extends at an angle to the bottom surface ranging between one hundred and fifteen degrees and one hundred and fifty five degrees.

22. A practice hockey puck as claimed in claim 13 wherein the lower portion is formed by a ring of spaced apart posts.

23. A practice hockey puck comprising; a cylindrical upper portion having a top, circular surface and a top, cylindrical, side surface extending down from the outer peripheral top edge of the top surface, the upper portion being between one quarter and three quarters the thickness of the puck; a lower portion having a bottom surface parallel to the top surface with the outer peripheral bottom edge of the bottom surface spaced inwardly of the top edge of the top surface, and a bottom, side surface joining the bottom edge of the bottom surface with the bottom edge of the top cylindrical side surface; the practice puck, when inverted with the top surface of the upper portion flat on a practice surface, being used to practice stickhandling the puck with a hockey stick.

* * * * *